United States Patent [19]

Wingstrom et al.

[11] 4,335,704

[45] Jun. 22, 1982

[54] DRAFT AIR SECONDARY COMBUSTION APPARATUS FOR STOVES

[76] Inventors: Lincoln Wingstrom; Ed Wingstrom, both of 107 W. Cedar, Ft. Morgan, Colo. 80701

[21] Appl. No.: 189,655

[22] Filed: Sep. 22, 1980

[51] Int. Cl.[3] ..... F23L 3/00

[52] U.S. Cl. ..... 126/293; 126/307 R; 126/312

[58] Field of Search ..... 126/312, 307 R, 80, 126/83, 84, 76, 69, 293, 316; 98/48, 40 V

[56] References Cited

U.S. PATENT DOCUMENTS

| | | | |
|---|---|---|---|
| 878,474 | 2/1908 | Waterbury et al. | 126/80 |
| 2,996,972 | 8/1961 | Johansson | 98/40 V |
| 3,327,945 | 6/1967 | Pfister | 126/307 R |

FOREIGN PATENT DOCUMENTS

| | | | |
|---|---|---|---|
| 1091529 | 4/1955 | France | 98/48 |

*Primary Examiner*—James C. Yeung
*Attorney, Agent, or Firm*—Robert C. Dorr

[57] ABSTRACT

A draft air combustion apparatus for directing substantially all of the draft air provided into a stove pipe for a stove upwardly into the stove pipe, and permitting a small amount of the draft air to flow downwardly into the stove to provide air to an area of combustion of the exhaust gases created by combustion in the stove in a region of the stove near the entrance to the stove pipe. The apparatus of the present invention including a plurality of vane elements located near the entrance of the draft flue to the stove pipe and being oriented parallel to each other and at an angle to direct the draft air upwardly.

6 Claims, 7 Drawing Figures

DRAFT AIR SECONDARY COMBUSTION APPARATUS FOR STOVES

BACKGROUND OF THE INVENTION

1. Field of the Invention.

This invention relates to devices for providing an afterburn or combustion of exhaust gases which are created by combustion in stoves such as wood and coal burning stoves. The invention also relates to devices for directing draft air flowing through a draft air flue into the stove pipe of a stove.

2. Discussion of the Prior Art.

Wood burning and coal burning stoves have been in existence for hundreds if not thousands of years. After suffering a setback in popularity, wood and coal stoves most recently are making a comeback.

The well known Franklin-type stove however, suffers considerable inefficiencies and poses certain dangerous conditions. The heat is too rapidly lost in such stoves, creosote pitch build-up is significant which could cause chimney fires, and there is no overall control of the fire burning in the stove. Furthermore, the burning of wood is incomplete resulting in the production of volatile gases, carbon monoxide, and other undesirable gases such as sulphur dioxide. Pitch build-up in the stove pipe results from the deposition of creosote vapors and is due to a number of factors such as incomplete combustion of the creosote vapors in the exhaust, the existence of high humidity in the exhaust, and the coolness of the stove pipe.

Numerous advances over the conventional Franklin-type stove have been made to make them more air tight and to provide greater control over the burning of logs, to allow the logs to burn longer, to retain the heat in the fireplace for a longer period of time and not to lose the heat up the chimney. One approach was to use the downdraft design for feeding air to the primary fire in order to drive the smoke back into the fire. Such downdraft designs were difficult to tend. However, the problem of pitch build-up, the problem of creating significant pollutants such as ash and carbon monoxide still exist. Even with such improvements, however, the hazard of flue fires caused by pitch build-up is great.

Secondary combustion of the exhaust gases, by providing a separate chamber, by providing a separate air supply or by providing both have been used with limited success. It is desirable to create a second combustion area in addition to the primary combustion area. In such a secondary area, the pollutants can be significantly reduced, carbon monoxide can be converted to carbon dioxide and pitch build-up from condensation of creosote gases can be minimized. One approach to providing an afterburn or secondary combustion area is to provide an inlet of air into the region of the stove near where the stove connects with the stove pipe. In these prior art approaches, room air is inputted into an area of below or near the area of the afterburn or secondary combustion. Such approaches, however, also provide air to the primary area of combustion and thus may cause an increased rate of combustion and also cause significant loss of heat to occur upwardly through the chimney. Also, this type of approach increases heat production, increases exhaust gas rise rate and increases the overall combustion rate. Back puffing of smoke also may occur, resulting in possible backflash.

The present invention seeks to improve the efficiency of combustion of the creosote vapors in the afterburn area thereby significantly reducing the build-up of pitch, seeks to reduce the number of pollutants in the atmosphere, seeks to minimize the production of carbon monoxide and to encourage the production of carbon dioxide, seeks to preserve the retention of heat in the fireplace, seeks to decrease the rate of combustion of the logs in the fireplace, by providing a regulated amount of air to the region of the afterburn or secondary combustion from above the area of secondary combustion. The present invention uses air from a source of draft air located in the stove pipe above the area of afterburn.

Under the teachings of the present invention, the vacuum created by the fire and the rising gases pulls a portion of the draft air downwardly to the region of second combusion. This draft air which is pulled down is pre-heated and mixes with the exhaust gases to provide further combustion of the exhaust gases in a region near the connection of the stove pipe to the stove within the stoves heat exchange area. The addition of the draft air from above does not increase the rate of primary combustion in the stove. Furthermore, the draft air delivered downwardly is regulated being affected by the pressure in the stove pipe. And, because the source of air for the secondary combustion is delivered from the stove pipe downwardly, the heat in the stove is significantly retained over prior approaches because the hot vapors remain in the stove for a longer period of time. While this is occurring, the primary fire can be controlled to a desired rate of combustion since its source of air is not affected by the source of air for the secondary combustion.

Also under the teachings of the present invention, substantially all of the draft air is delivered upwardly in the stove pipe to maintain the pressure in the stove pipe (and not to draw through the fire on the primary intake) and to reduce the overall temperature of the pipe.

SUMMARY OF THE INVENTION

This invention involves an apparatus for directing draft air flowing through a draft flue into a stove pipe wherein the draft air may be regulated by a device known as a barometric draft control. The invention includes a plurality of vanes and a band for holding the vanes in the interior of the draft flue at a location near the interconnection between the draft flue and the stove pipe. The plurality of vanes are arranged parallel in spaced horizontal relationship to each other and are angled upwardly to direct substantially all of the draft air upwardly into the stove pipe to provide a thorough intermixing of draft air with the hot exhaust air coming from the stove. A small portion of the draft air is permitted to flow downwardly into the stove pipe into a region of the stove near the interconnection of the stove with the stove pipe to feed air to an area of afterburn or secondary combustion of the exhaust gases. The addition of this air to this region creates the afterburn which significantly minimizes ejected pollutants from the chimney, converts carbon monoxide gases to carbon dioxide gases, and reduces the pitch build-up in the stove pipe due to the combustion of the creosote gases contained in the exhaust gases. The creation of an afterburn region also provides for longer primary combustion in the stove and greater heat retention in the stove.

DETAILED SPECIFICATION

Figure 1:
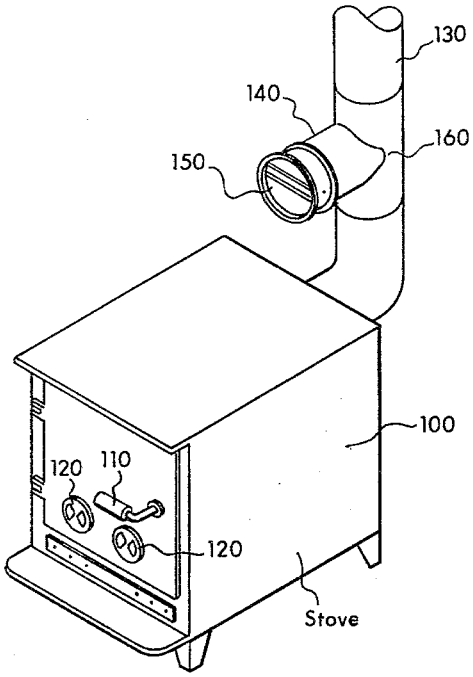
FIG. 1 is an illustration showing in perspective a conventional wood burning stove, stove pipe, and barometric draft control.

In FIG. 1 is shown a conventional wood burning stove 100 having a handle 110 and air vent controls 120. Connected to the stove 100 is a stove pipe 130. Also interconnected with the stove pipe 130 is a draft flue 140 containing a barometric control 150. All of the elements shown in FIG. 1 are conventional and readily available. The barometric draft control 150 can be of the type manufactured by Field Controls of Mendota, Illinois and sold as Type R-C. The primary purpose of the barometric draft control 150 is to control the rate of combustion or burning in the stove. The barometric draft control 150 is interconnected to the draft flue 140 which is mounted perpendicularly to the stove pipe 130 by means of a tee-joint 160. Typically, the draft control 150 is located near the stove such as six inches to twelve inches away.

Figure 2:
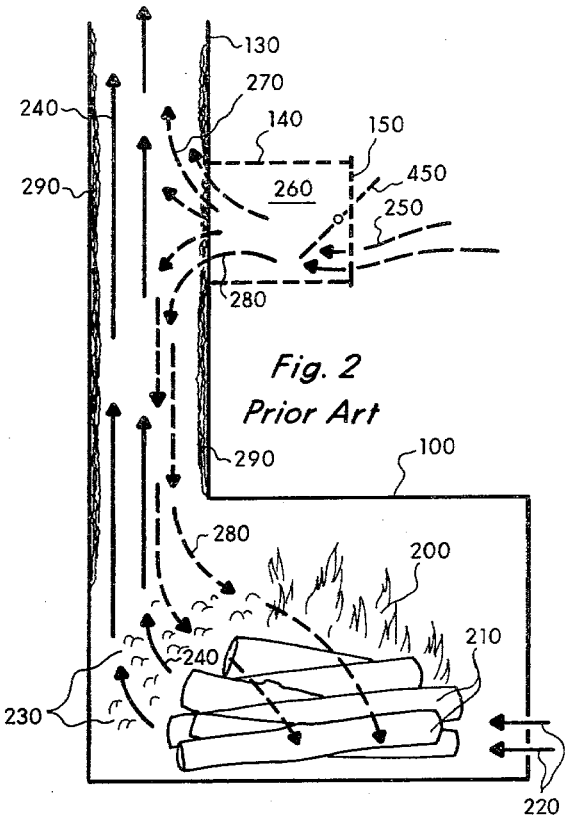
Fig. 2 Prior Art
FIG. 2 is an illustration setting forth the operation of a conventional barometric draft control in conjunction with the burning of wood in a conventional wood stove.

In the conventional operation, the components set forth in FIG. 1 function as shown in FIG. 2. FIG. 2 shows a standard stove arrangement with the optional use of a barometric draft control 150 shown in dotted lines. A combustion or burn 200 is created by means of igniting the logs 210. Intake air 220 is delivered through vent controls 120 to provide air for the combustion. The exhaust gases 230 rise in the direction of arrows 240 upwardly into the stove pipe 130. A controlled amount of draft air 250 is delivered through the barometric control 150 and into the flue passageway 260. Some of the draft air 250 designated by arrows 270 is delivered upwardly into the stove pipe 130 to mix with the exhaust and some of the draft air 250 designated by arrows 280 is delivered downwardly to feed the combustion of the logs 200. The purpose of the draft air is to control the rate of combustion and to thereby provide a more uniform burn. Additionally, the draft air 280 allows the stove to retain more heat by restricting the direct loss of heat up the stove pipe as does occur without the use of the draft control. The use of such draft controls are primarily on kerosene stoves and not on wood stoves.

Without the use of the barometric draft control 150 and as shown in FIG. 2, creosote in the vaporized state, is present in the exhaust gases 230. Vaporized creosote can be condensed onto the sides of the stove pipe 130 as pitch 290. The condensation of the creosote from the exhaust gases 230 is caused by the cool temperature of the stove pipe 130 and the large amount of moisture in the logs 210. The amount of creosote pitch 290 deposited on the stove pipe is dependant upon a number of factors such as moisture contained in the logs 210, the temperature of the stove pipe 130, the rate at which the logs 210 are burned, the amount of draft air 250 present in the stove pipe, and how complete the combustion of the exhaust gases are in the combustion chamber 200 of the stove 100. The optional use of the draft control 150 shown in FIG. 2 can significantly reduce some of the deposition of pitch due to the addition of dry air, however, the barometric draft control 150 primarily provides an automatic regulation of the draft air 280 to the combustion area 200. In doing so, the draft control 150 also significantly increases the rate of combustion which is undesirable. Hence, although pitch build-up is reduced, the rate of combustion is increased. The goal of the present invention is to modify the draft control 150 to maintain a low combustion by feeding air only to the region of secondary combustion and not to the primary combustion.

Figure 3:
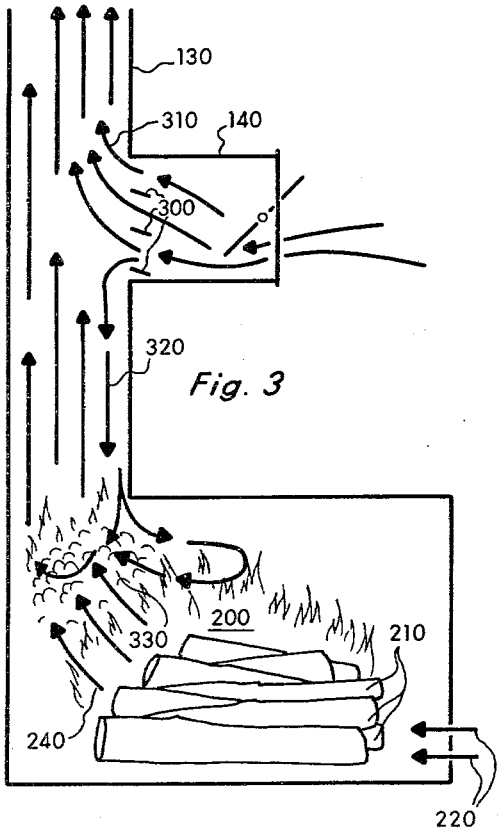
FIG. 3 is an illustration similar to FIG. 2 illustrating the principles of the present invention.

In FIG. 3, the vanes 300 of the present invention are located at the junction of the draft flue 140 and the stove pipe 130. The vanes 300 of the present invention direct substantially all of the draft air 250 upwardly in the direction of arrows 310 to mix with the hot exhaust gas. A small amount of the draft air 250, however, is permitted to become preheated by flowing downwardly in the direction of arrows 320 to provide air for a secondary combustion of the exhaust gases 240 or after-burn in region 330 of the stove near the entrance to the stove pipe 130. It is believed that if any draft air reaches the primary combustion area 200 it is miniscule. Under the teachings of the present invention, however, air for the primary combustion chamber 200 is provided by the control vents 120 as intake air 220 which results in the generation of exhaust gases 240 containing vaporized creosotes, water vapor, and other by-products such as carbon monoxide. Because of the heat generated in the combustion chamber 200 and the provision of air 250 which stirs the exhaust gases, a secondary combusion or afterburn occurs in the combustion area 330 which more fully combusts the creosote gases and carbon monoxide thereby substantially minimizing the pitch build-up 290 on the sides of the stove pipe 130 and substantially minimizing the production of carbon monoxide gases since the latter is reburned into carbon dioxide gas.

In comparison to the prior art approach shown in FIG. 2 which provides feed of draft air 280 directly into the primary area of combustion 200, the present invention substantially prevents this form of air feed by directing the draft air upwardly into the stove pipe 130 by means of the vanes 300. Rather, the vanes 300 of the present invention provides a limited draft air feed 320 which provides air to a secondary combustion area 330 to more fully combust the vaporized creosote. Hence, the use of the vanes 300 of the present invention significantly reduce creosote build-up 290 in conventional stove pipes 130.

Futhermore, the use of vanes 300 to prevent a primary feed 280 of draft air 250 into the main combustion area 200 permits the combustion of the logs 210 to take longer since the only air for combustion is from air 220. Hence, the time that it takes to burn the log 210 increased through use of the vanes 300 of the present invention.

In other words, when it is desired to have a slow heat from the stove 100, the control valves 120 are set to allow a small amount of air 220 to be imputted into the primary combustion area 200. This results in greater smoke (i.e., exhaust gases 230 including creosote vapor, water vapor, carbon monoxide, and other by-products) being generated from the combustion area 200. Conventionally, the barometric draft control 150 is set at a point where the smoke or exhaust gases 230 start to back into the combustion area 200. Hence, the use of the barometric draft control 150 is to provide an appreciable amount of draft air into the primary combustion area 200. Although the conventional draft control 150 has as one of its purposes to provide uniform burning, it also does reduce the build-up of creosote.

Implementing the vanes 300 of the present invention, and as shown in FIG. 3, the draft air feed 320 is limited to providing a second or afterburn combustion area 330 which has as its purpose a more complete combustion of the creosote vapors and the carbon monoxide gases found in the exhaust 240 and once this occurs, only a minimum amount of pitch will build up. At the same time, the desired combustion of the logs 210 in combustion area 200 is achieved by regulation of the valves 120 resulting in longer burning time and less carbon monoxide gas is generated. Finally, the provision of the draft air from a position above the area of secondary combustion improves the heat retention of the stove.

Figure 4:
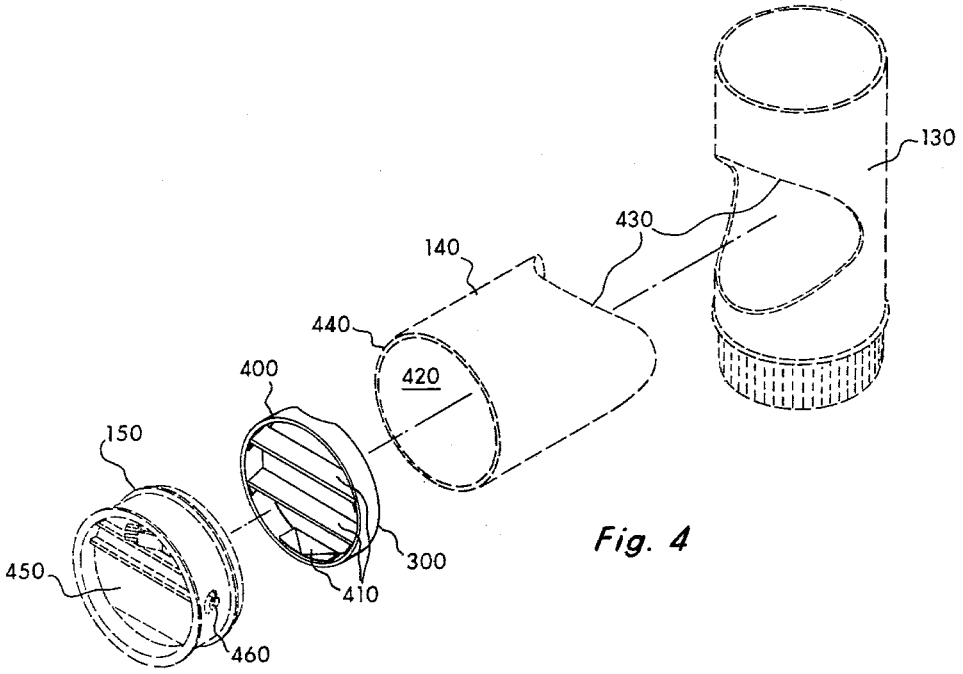
FIG. 4 is an exploded perspective view of the apparatus of the present invention in relationship to a conventional tee connection and barometric draft control.

In FIGS. 4 through 7, the details of the vane 300 of the present invention are set forth. In FIG. 4, the vanes 300 include a circular band 400 containing a plurality of elongated flat vanes 410 which are mounted in spaced horizontal relationship to each other and affixed at opposing ends to the circular band 400. The particular band 300 is designed, in the preferred embodiment, to slideably engage the interior surface 420 of the draft flue 140. As can be seen in FIG. 4, the draft flue 140 forms a conventional tee connection with the stove pipe 130 and the juncture designated by lines 430 can be welded together. The barometric draft control 150 slideably interconnects with the end 440 of the flue draft 140. The details of the operation and construction of the draft barometric control 150 are not material for this invention. However, the barometric draft control 150 has a vent 450 which is pivotally mounted by means of pins 460.

Figure 5:
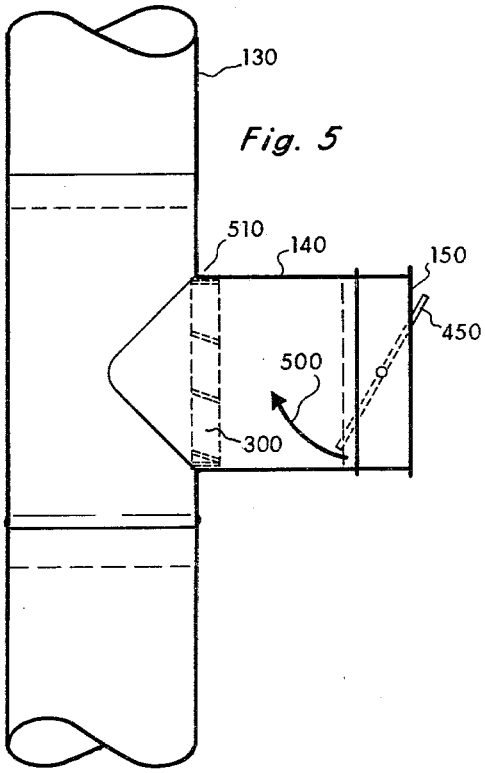
FIG. 5 is a planar side view of the present invention being mounted in a conventional tee-joint as illustrated in FIG. 4.

As shown in FIG. 5, when the barometric draft control 150 is installed to the draft flue 140 with the vents 300 of the present invention firmly installed on the interior of the flue draft 140, the vent 450 is able to pivotally swing in the direction of arrow 500 and will not strike the inserted vane 300 of the present invention as it pivotally travels. The vanes 300 engage the interior surface 420 of the draft flue 140 at the location near the perpendicular junction 510 of the draft flue 140 of the stove pipe 130. Indeed, the vanes 300 of the present invention can be slideably inserted into the interior of the flue 140 or can be manufactured at that location by welding the vane 300 to the interior surface 420 of the flue 140.

Figure 6:
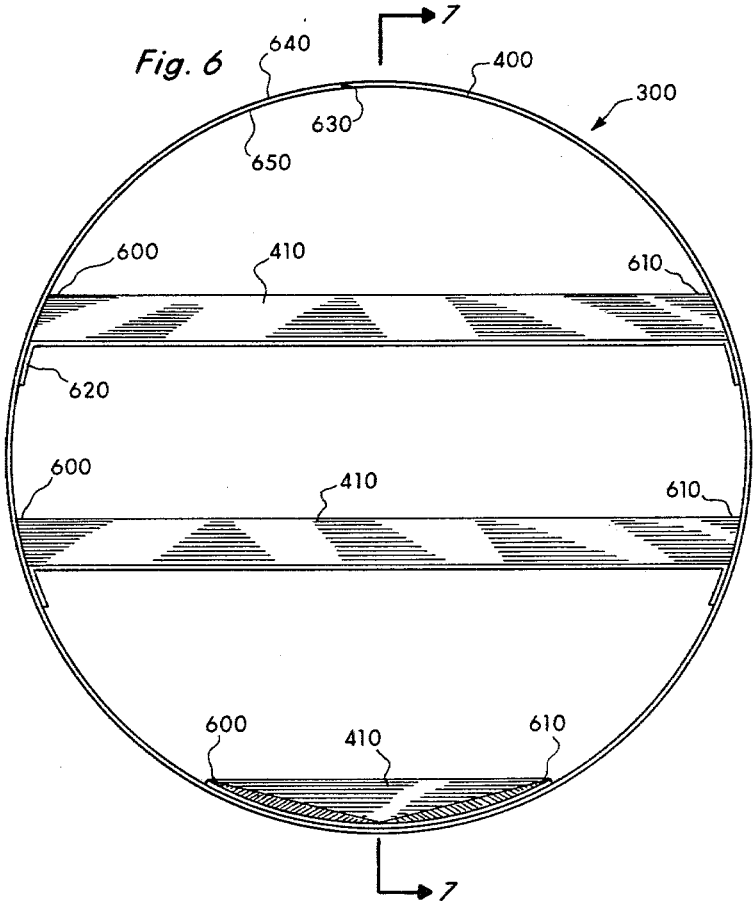
FIG. 6 is a side planar view of the apparatus of the present invention.

FIG. 6 illustrates the orientation of the vane element 410 to the band 400. In the preferred embodiment, the vane elements 410 are a rectangular flat surface having a thin wall 630 separating the exterior surface 640 from the interior surface 650 and wherein opposing ends 600 and 610 are affixed to the band 400. In the preferred embodiment, the opposing ends 600 and 610 for the uppermost vanes 410 have corners 620 which are affixed by means of welding or the like to the interior surface 700 of the band 400 as best shown in FIG. 7.

Figure 7:
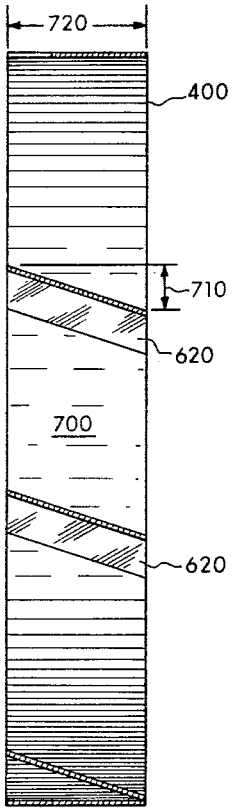
FIG. 7 is a cross-sectional view of the apparatus of the present invention shown in FIG. 6.

As also shown in FIG. 7, the vanes 410 are oriented on an angular relationship to the band so that for a given distance 720 there is a given rise 710. In the preferred embodiment, the band 400 is one and onehalf inches wide and the rise 710 is three quarters of an inch thereby effectuating an upward angular relationship of 33 degrees.

The lower most vane 410 which is located at the bottom of the band 400 insures that the incoming draft air 250 will be directed upwardly. In the preferred embodiment, three vanes 410 are utilized although it is to be expressly understood that more than three may be effectively utilized although it is not presently contemplated that less than two could be effectively utilized. Furthermore, it is to be expressly understood that although the preferred embodiment utilizes an angular relationship of 33 degrees, that other angular relationships that carry forth the spirit of the present invention as shown in FIG. 3 could be effectively utilized. Hence, various changes and modifications may be made to the preferred embodiment set forth in the figures without departing from the scope of invention set forth in the following claims.

I claim:

1. An apparatus for directing draft air flowing through a draft flue into a stove pipe, said draft flue being interconnected substantially perpendicular with said stove pipe, said stove pipe being interconnected to a stove for conveying exhaust gases upwardly from said stove, said apparatus comprising:

means for firmly engaging the interior periphery of said draft flue, said engaging means located near said interconnection of said draft flue and said stove pipe;

a plurality of vanes connected to said engaging means for directing substantially all of said draft air in an upward direction into said stove pipe, a small amount of said draft air being allowed to flow downwardly into said stove pipe to provide additional oxygen to only an area of secondary combustion of said exhaust gases located in a region of the stove near the entrance to said stove pipe, each of said vanes comprising an elongated horizontal surface, and each of said vanes being further angled upwardly to direct said draft air in said upward direction, said additional oxygen provided to said secondary area of combustion being capable of enabling said secondary area of combustion to substantially combust the creosote vapors in said exhaust gases thereby minimizing the build-up of creosote on the interior of said stove pipe.

2. The apparatus of claim 1 wherein said engaging means comprises a band of material having interior and exterior surfaces separated by a thin wall, said exterior surface of said band being capable of firmly abutting said interior surface of said draft flue.

3. The apparatus of claim 2 wherein each of said vanes has said opposing ends affixed to said interior surface of said band so that said plurality of elements when affixed are oriented in parallel spaced relationship to each other.

4. The apparatus of claim 3 wherein one of said vanes is affixed to the bottom of said band.

5. The apparatus of claim 3 wherein said vanes are angled upwardly substantially at 33 degrees.

6. An apparatus for directing draft air flowing through a draft flue having a circular cross-section into a stove pipe having a circular cross-section, said draft flue being interconnected in a perpendicular tee-joint relationship to said stove pipe, said stove pipe being interconnected to a stove for conveying exhaust gases originating from a primary combustion area in said stove upwardly from said stove, said apparatus comprising:

a circular band having an interior and an exterior surface separated by a thin wall for firmly engaging the interior periphery of said draft flue, and a plurality of elongated flat vanes, each of said vanes being affixed on opposite ends to said interior surface of said band, each of said bands being further oriented to be in parallel spaced relationship to each other and to be angled to deliver a portion of said draft air into the interior region of said stove near the entrance to said stove pipe to provide additional oxygen for a secondary combustion of said exhaust gases and to minimize delivery of any of said draft air into said primary combustion area of said stove, said additional oxygen provided to said secondary area of combustion being capable of enabling said secondary area of combustion to substantially combust the creosote vapors in said exhaust gases thereby minimizing the build-up of creosote on the interior of said stove pipe.

* * * * *